US012011062B2

(12) United States Patent
Scheinberg et al.

(10) Patent No.: US 12,011,062 B2
(45) Date of Patent: Jun. 18, 2024

(54) ORTHOPEDIC FOOT INSERT

(71) Applicant: The Seaberg Company, Inc., Wilsonville, OR (US)

(72) Inventors: Samuel Scheinberg, Portland, OR (US); Cheryl Scheinberg, Portland, OR (US)

(73) Assignee: The Seaberg Company, Inc., Wilsonville, OR (US)

( * ) Notice: Subject to any disclaimer, the term of this patent is extended or adjusted under 35 U.S.C. 154(b) by 324 days.

(21) Appl. No.: 15/993,349

(22) Filed: May 30, 2018

(65) Prior Publication Data

US 2018/0352903 A1 Dec. 13, 2018

Related U.S. Application Data

(60) Provisional application No. 62/518,440, filed on Jun. 12, 2017.

(51) Int. Cl.

| | |
|---|---|
| ***A43B 17/03*** | (2006.01) |
| ***A43B 3/00*** | (2022.01) |
| ***A43B 7/1464*** | (2022.01) |
| ***A43B 17/00*** | (2006.01) |
| ***A43B 17/14*** | (2006.01) |

(52) U.S. Cl.

CPC ..... *A43B 17/03* (2013.01); *A43B 3/0078* (2013.01); *A43B 7/1464* (2022.01); *A43B 17/006* (2013.01); *A43B 17/14* (2013.01)

(58) Field of Classification Search

CPC ..... A43B 7/1465; A43B 17/14
USPC ..... 428/152, 154
See application file for complete search history.

(56) References Cited

U.S. PATENT DOCUMENTS 1,537,848 A * 5/1925 MacDonald ..... A43B 23/086 428/142
2,254,883 A * 9/1941 Boyle ..... A61F 13/0203 128/889
2,355,168 A * 8/1944 Kuboveik ..... A43B 17/00 36/43
2,481,602 A * 9/1949 Lindh ..... B29C 66/8223 156/290
2,559,014 A * 7/1951 Fortier ..... A43B 17/00 36/44

(Continued)

FOREIGN PATENT DOCUMENTS

WO WO-0170060 A2 * 9/2001 ..... A43B 13/20
WO WO-2016172169 A1 * 10/2016 ..... B29D 35/122

OTHER PUBLICATIONS

"What's a Mil?" Plastic Bag Partners (Year: 2022).*
Teemy Tiny Tip: Folded Plastic Bags (Year: 2152).*

*Primary Examiner* — Elizabeth M Imani
(74) *Attorney, Agent, or Firm* — Schwabe, Williamson & Wyatt, PC

(57) ABSTRACT

A comfort insert to be worn inside a person's footwear to alleviate friction between the person's foot and surfaces of the footwear and possibly provide some cushioning, and a method of assembling such a comfort insert. A body portion of the insert may be of crumpled thin plastic film material, and a containment element may be of fine-filament open mesh netting. A portion of an exterior surface of the insert may be provided with a nonslip or adhesive coating to assist in keeping the comfort insert in a desired location.

11 Claims, 3 Drawing Sheets

(56) References Cited

U.S. PATENT DOCUMENTS

| | | | | |
|---|---|---|---|---|
| 4,183,156 | A * | 1/1980 | Rudy | A43B 17/035 36/29 |
| 5,154,682 | A * | 10/1992 | Kellerman | A43B 1/0072 36/44 |
| 10,362,833 | B2 * | 7/2019 | Campos, II | B32B 7/02 |
| 2008/0280526 | A1 * | 11/2008 | Chase | A63H 33/006 446/397 |
| 2015/0060504 | A1 * | 3/2015 | James | A45F 5/021 224/235 |
| 2018/0206598 | A1 * | 7/2018 | Bradley | A43B 1/08 |

* cited by examiner

ORTHOPEDIC FOOT INSERT

The present invention relates to relieving foot discomfort by providing a comfort-promoting insert that can be utilized within a person's footwear.

BACKGROUND OF THE INVENTION

It is well known that a person can experience great discomfort as a result of standing for lengthy times, particularly when wearing dress shoes, which often have hard, relatively incompressible heels and soles and which may lack significant cushioning in their insoles. When forced to stand relatively still or to stand for lengthy times on an unyielding surface such as a concrete or hardwood floor, and even when standing on a carpeted floor, a person's foot may stay practically motionless within the confines of a shoe. The nearly constant pressure and the effects on one's foot of shear stress, caused by the interior surfaces of a shoe tending to pull the skin of the bottom and sides of the person's foot in one direction or another, can result in a significant amount of pain and tissue break-down. In addition, ill-fitting shoes that don't support the heels from expanding sideways under pressure, in conjunction with skin that is genetically dry or dry from metabolic conditions associated with aging and diabetes can lead to extremely painful skin fissures most commonly seen in the heel area. Shear and friction forces exacerbate these cracks, increase pain, and prolong healing.

Many shoes, particularly athletic shoes, incorporate padded and appropriately-shaped insoles which may be of significant benefit in preventing discomfort and pain. Most dress shoes, including women's high-heeled shoes, however, have relatively hard and inflexible insoles which may not be well shaped to conform to a person's foot. Dress shoes for men commonly have stiff unyielding rear quarters and front vamps that do not match the wearer's anatomy. These portions of the shoe may be too tight, excessively compressing the wearer's heel or forefoot, or too loose, allowing the foot soft tissue to expand over time and flatten within the shoe. The former condition leads to skin breakdown and blister formation, the latter condition may result in skin fissuring and cracking. The insoles of men's and women's dress shoes often are not shaped to conform to the arches of a person's foot, and sometimes are not even smooth. They may not include sufficient padding to prevent the wearer from feeling structural parts of the shoe, such as nails attaching a heel to a shoe sole. Standing for lengthy times in such dress shoes may often be necessary, however, for a person to present a socially desirable appearance or an appropriate business appearance.

While it may be impossible to avoid wearing shoes that are uncomfortable, it is desired to provide a remedy for the situation so that a person can dress in what may be socially-required footwear while standing for a considerable amount of time without pain or discomfort. In order to remedy that situation, it has long been known that various types of scientifically-shaped and cushioned inserts, some of which are specifically designed for a person's foot, can be worn within a shoe to improve comfort. They may also require some careful selection and may need to be cut to a particular shape to fit in a particular shoe. Some such inserts can be fashioned by specialists, as by molding foam materials to fit a particular person's foot and shoe. Most such inserts, however, are relatively expensive.

What is needed, then, is a comfortable yet simple and inexpensive insert that can be worn in a person's shoe to prevent or provide relief from discomfort and pain. Preferably, such an insert should not require extensive or skillful measurement and fitting to be effective and to maintain efficacy during extended use.

SUMMARY OF THE INVENTION

In order to provide a solution to the above-mentioned need, the present disclosure describes a comfort insert for use in footwear. Such an insert is simple in construction, yet effective in reducing potentially-painful shear stress on a person's foot, and also provides cushioning for a person's foot.

The comfort insert disclosed herein promotes pain relief by dissipating shear and friction, preventing the heel and forefoot from expanding sideways under pressure, redistributing the body weight more evenly, and promoting shock absorption. All of these provisions are enhanced by the ability of the insert to adapt to changes in foot size that may occur during prolonged use.

A feature of one embodiment of the comfort insert disclosed herein is the inclusion of multiple layers of a thin, low-friction film material allowing a person's foot to move in the transverse, coronal, and sagittal plates within a shoe, with a reduced amount of shear strain imposed on the person's foot.

One embodiment of the comfort insert disclosed herein provides an amount of cushioning and results in improved comfort, without occupying an undesirably large amount of space within a person's shoe.

It is a feature of the comfort insert disclosed herein that it can be manufactured in a single or multiple configurations of sufficient size to extend in the sagittal plane partially up the lateral borders of the foot so as to conform effectively to many sizes and shapes of shoes and feet to provide improved comfort for the user.

As a principal aspect, the disclosure herein provides a comfort insert for use in footwear, comprising a shear-reducing body element including a plurality of layers of a thin plastic film material with a low coefficient of friction in mutual contact with one another, preferably with some air or a lubricant material trapped between the mutual layers and a flexible containment element surrounding and enclosing the body element.

Another principal aspect of the disclosure herein is the provision of a method for making an insert for a shoe, comprising providing at least one sheet of flexible, low-friction, film material and at least one piece of a flexible fluid-permeable containment material; crumpling the sheet of flexible film material into a loose mass including a plurality of folds and preferably including some air or a lubricant material trapped between the folds, and a plurality of overlying and mutually confronting surface areas; wrapping the containment material around the mass of crumpled flexible film material; and securing the containment material around the flexible film material so as to retain the mass in an amorphous configuration capable of being shaped and compressed while retaining the plurality of folds and mutually confronting surface areas.

The foregoing and other features and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1A:
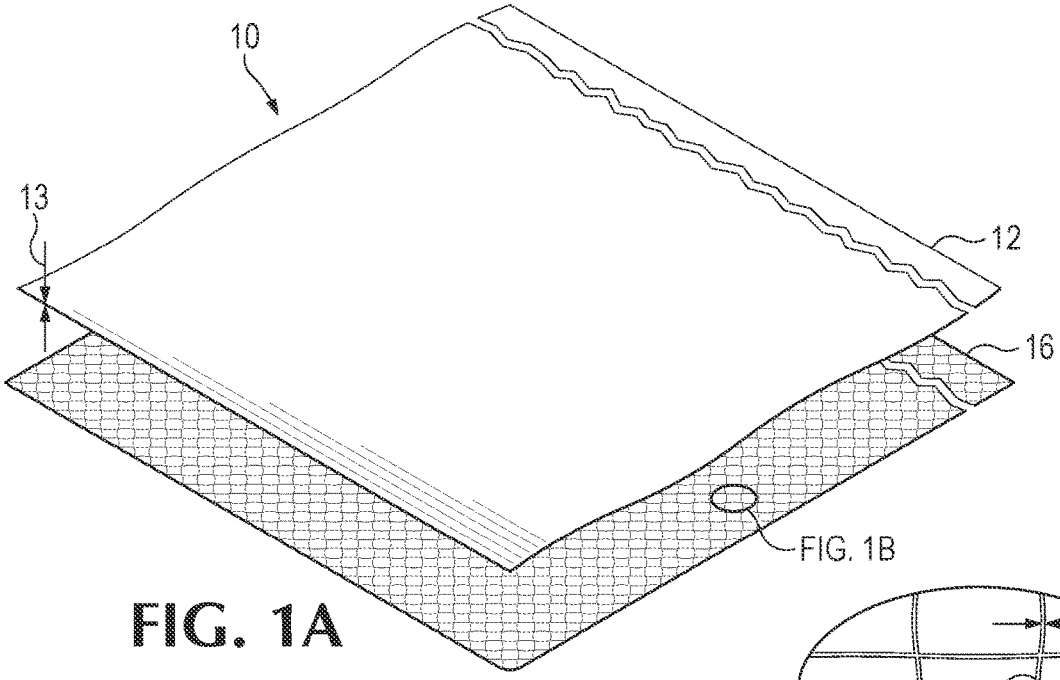
FIG. 1A is an isometric view of materials to be incorporated in a comfort insert for a person's footwear.

Referring to the drawings which form a part of the disclosure herein, FIGS. 1A-1D illustrate one method of assembling a comfort insert 10 for use within a person's footwear. Construction may begin with a sheet of a flexible thin plastic film 12, as shown in FIG. 1A. The plastic film 12 is preferably very thin, with a thickness 13 illustrated in FIG. 5 that is preferably less than 0.003 inch and may, for example, be about 0.0005 inch. The film material 12 should have a low coefficient of friction, and may, for example, be polyethylene film having a thickness 13 of 0.0005 inch. Such film material is commonly available and used by laundries and dry cleaners to protect apparel that has been laundered or dry cleaned. Such film commonly has a static coefficient of friction in the range of 0.25 or below. The film material 12 may, alternatively, be polyurethane film of a similar thickness, also widely available, but often having a somewhat higher, yet still low, static coefficient of friction. The coefficient of friction of such polyurethane film may preferably be in the range of 0.5 or below. Other plastic film materials may also be suitable if they are sufficiently flexible yet resilient and have a sufficiently low coefficient of friction to perform as explained below.

The thickness 13 of the film material 12 is preferably small, in the range of 0.0003-0.003 inch, so that several layers of the film material 12 will still amount to no more than the thickness of a person's stocking or sock. Using such thin film material 12 will give the result that the comfort insert 10 will not easily be felt and noticed as a foreign object present within the footwear in which the comfort insert 10 is being used. A further reason for the film material 12 to be thin is to ensure that it will be flexible enough so that several layers of the film are free to move with respect to each other, with folds of the film easily rolling and allowing the layers of film on either side of a fold to slip along each other.

At the same time, some thickness and a small amount of resiliency, or springiness, in the film and possibly some air trapped between the folds of the film may be desired, as it can result in the comfort insert 10 being able to provide a small amount of cushioning. In that respect, a film 12 of polyethylene having a thickness 13 of 0.002 inch can provide some noticeable cushioning. The comfort insert could be made using film 12 of polyethylene of a thickness 13 within the range of 0.0005-0.003 inch to provide a selected amount of resiliency and cushioning. A thickness 13 of polyethylene film of about 0.001 inch has been found to be a very good compromise with ample flexibility yet some useful resiliency.

Figure 1B:
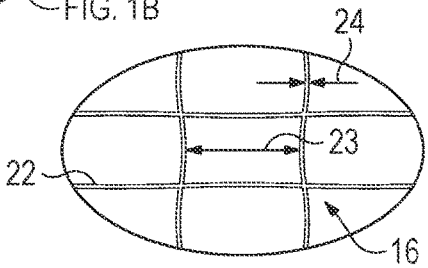
FIG. 1B is a detail view of a portion of a layer of netting material that may be used as one component of the comfort insert.
Figure 1C:
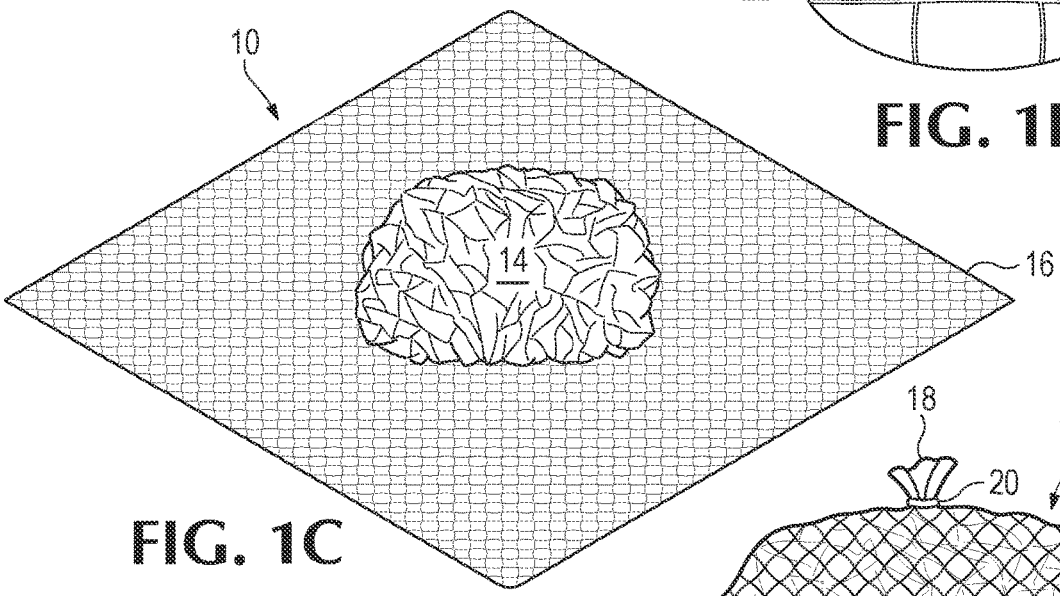
FIG. 1C is a view similar to that of FIG. 1A showing a partially assembled comfort insert.
Figure 1D:
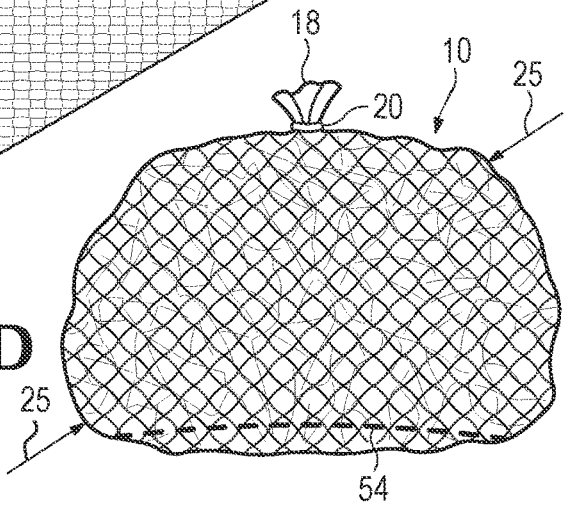
FIG. 1D is an elevational view of a completed comfort insert, as it appears prior to use.

As shown in FIGS. 1A and 1C, in making one preferred embodiment of the comfort insert 10 a single sheet of film 12, for example a sheet of polyethylene, whose thickness 13 is 0.001 inch and whose area is about 1 square yard, is crumpled or wadded. The film 12 is thus wrinkled and folded to some extent incidentally and randomly folded, to form a loose, rounded, ball-like mass to serve as the friction-reducing, shear-reducing body 14 of the comfort insert 10, as shown in FIG. 1C.

Assembly of this embodiment of the comfort insert 10 proceeds further with wrapping piece of a material such as an area of an open-mesh netting material 16, formed of very fine filament, as shown in FIGS. 1A, 1B, and 1C, around the body 14 and fastening the netting material to form an enclosing or containment element 18 surrounding the body 14. The material 16 of the containment element 18 should be flexible and permeable to fluid. Preferably the material 16 of the containment element 18 is open enough to expose areas of the flexible film material 12, and so an open mesh netting is particularly suitable. A sufficiently strong thin film or other thin, flexible sheet material could also be used as the containment element 18 so long as it is capable of containing the body 14 despite forces that may be applied to the comfort insert 10 when it is in use. Such a film used as the containment element 18 should preferably be perforated to generously expose areas of the film material 12 of the body 14. Alternatively, or additionally, such film material should itself be somewhat slippery.

Within the body 14 the thin film material 12 is simply crumpled and wadded into a loose ball shape. Preferably the thin film material 12 thus includes many loosely formed folds and several overlying individual areas whose surfaces confront one another, as shown, for example, in FIG. 5. The netting or other highly pervious or perforated material 16 is then gathered around the body 14 to form the containment element 18 as by, for example, tying a suitably strong yet fine filament or thread 20 around the gathered material 16 to contain and enclose the body 14. Because the filaments defining the mesh of the netting material 16 are very fine the bunched netting, even when securely tied, still forms only a very small lump, that is unlikely to be intrusive when the comfort insert 10 is in place, particularly if the tied lump of netting is kept to one side when the comfort insert 10 is placed into a person's footwear for use.

As shown in FIG. 1B, the material 16 of the containment element 18 in one preferred embodiment of the comfort insert 10 may be a netting material of fine filaments 22 forming an open mesh with generally square mesh openings having a mesh opening dimension 23 in the range of 0.20 inch-0.75 inch, for example, preferably about ⅜ inch. Netting material found to be satisfactory for use as the material 16 of the containment element 18 is widely available and used as hair netting by food service personnel, for example. Individual filaments of sufficient strength for forming the meshes of such netting may be of a flexible material such as a polyester or a polyimide, for example. The filaments forming the mesh may have, for example, diameters 24 of 0.0005-0.004 inch and preferably in the range of 0.002 or 0.003 inch. Since the filaments 22 forming the meshes are of very small diameter, the exposed area of the thin plastic film material 12 of the body 14 is far greater than the combined area of filaments of such netting material 16 of the containment element 18, and so a majority of the exterior of the comfort insert 10 is low-friction surfaces of the flexible thin-film material 12 of the body 14, exposed through the containment element 18. As an additional means of securing the crumpled and folded thin plastic film material 12 into a unified body 14 a very fine filament or thread (not shown) may be sewn loosely through the entire ball or body 14 either before or after the netting 16 or other pervious material is wrapped around it as the containment element 18. This additional means may help the containment element 18 and the comfort insert 10 in general, to retain a desired form or shape.

The comfort insert 10 when thus completed need not have any particular shape, but may initially be in a generally spherical shape as a ball having a diameter 25 in the range of 2 inches-5 inches, preferably in the range of 3 inches-4 inches. The body 14 is loosely formed, and so the portion of the comfort insert 10 beneath a person's foot can easily be compressed into a flat and relatively thin configuration within a user's shoe or other footwear.

Figure 2:
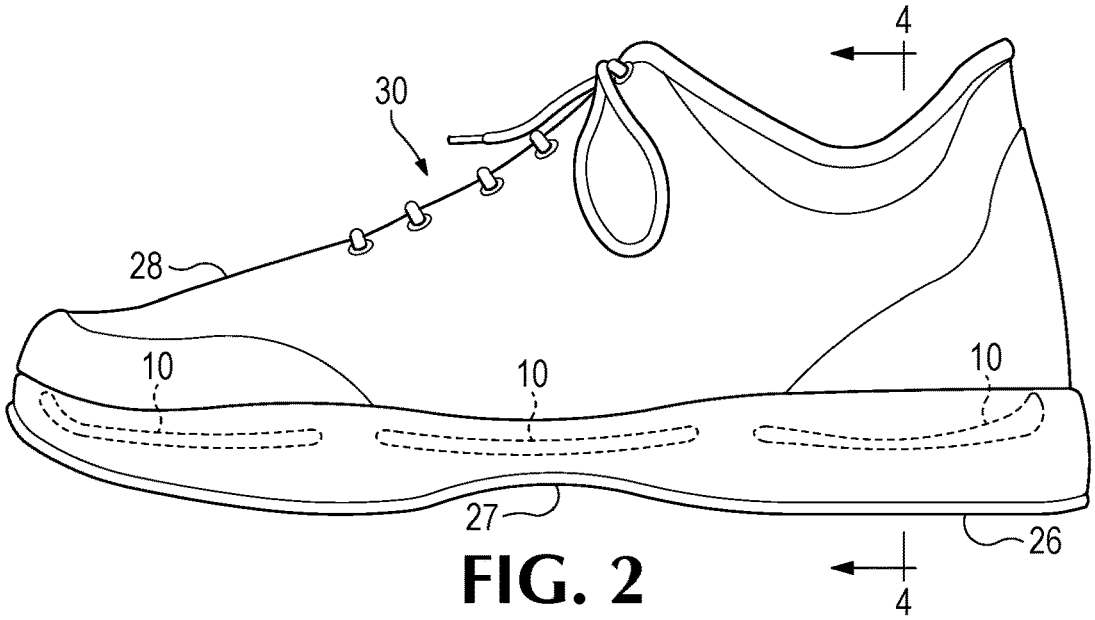
FIG. 2 is a side elevational view of a shoe, showing various positions where the comfort insert shown in FIG. 1D might be utilized.
Figure 3:
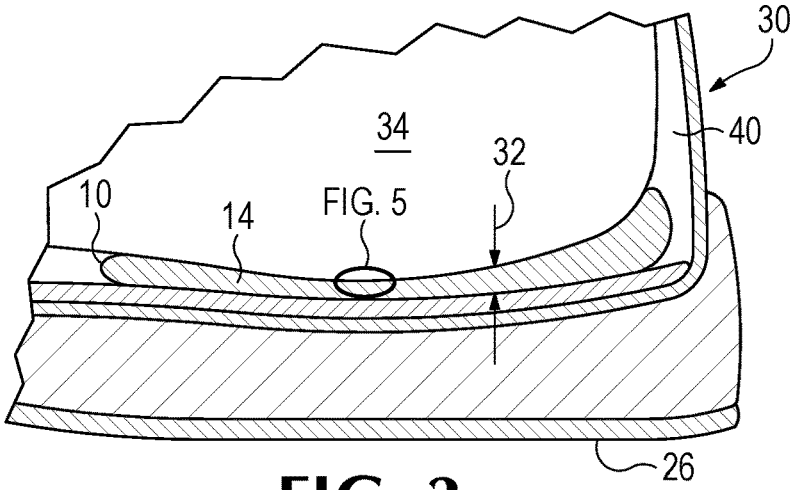
FIG. 3 is a sectional view taken in a longitudinal vertical plane in a heel portion of the shoe shown in FIG. 2, showing a portion of a person's heel, along with the comfort insert in place within the shoe.
Figure 4:
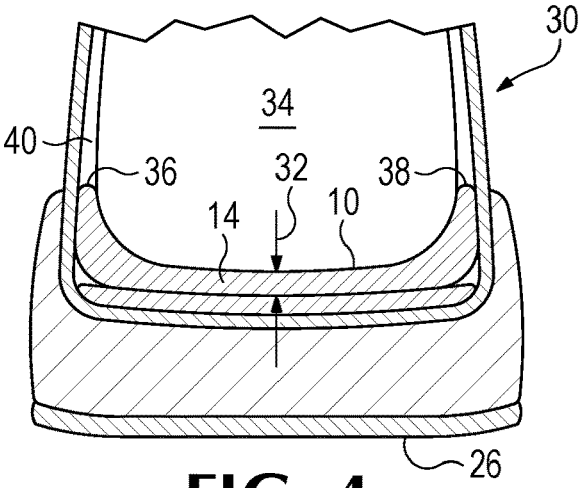
FIG. 4 is a sectional view taken in the direction of line 4-4 in FIG. 2.

The comfort insert 10 may be placed in any desired location within a person's shoe to provide support and reduce friction. For example, as shown in FIG. 2, comfort inserts 10 are shown in place in a heel portion 26, an arch portion 27, or a toe box portion 28 of the shoe 30. In each location where the comfort insert 10 is placed, the user's weight squeezes at least a main portion of the comfort insert 10 down to a relatively very thin vertical dimension or thickness 32 immediately under the user's foot 34, while outer margins 36 and 38 of the comfort insert 10 may remain less compressed and serve to fill otherwise unoccupied space 40 within the shoe 30, as shown in FIGS. 2, 3, and 4.

Figure 5:
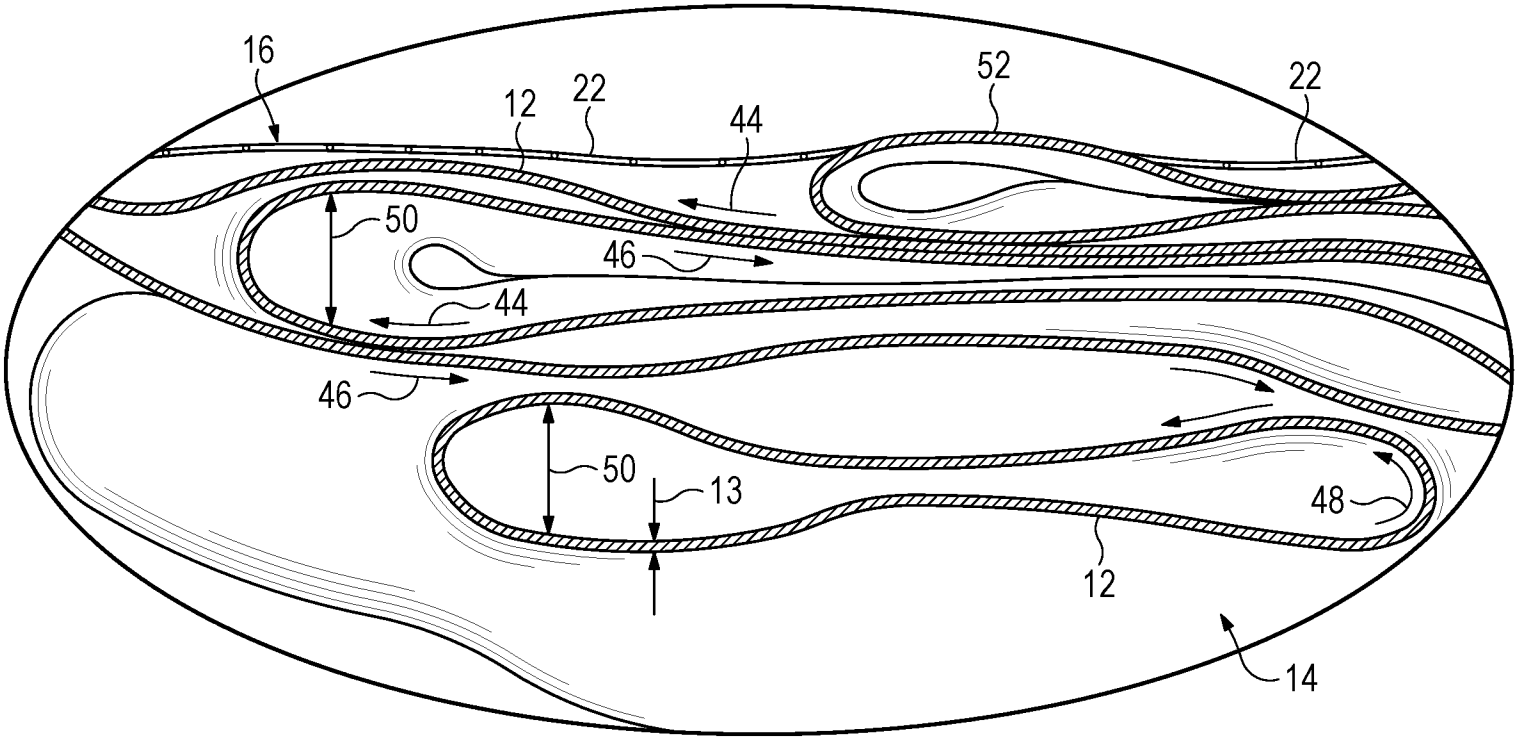
FIG. 5 is a detail view at an enlarged scale, showing a portion of the sectional view in FIG. 3 of the comfort insert in use.

As shown best in FIG. 5, the crumpled film material 12 of the body 14 of the comfort insert 10 includes several layers of the film material 12 that are free to slip and slide along one another's surfaces, as in the directions relative to each other indicated by the arrows 44 and 46. Because of the low coefficient of friction of the thin film material 12, as well as a quantity of air or other lubricant material that may be trapped between the thin layers, the effective amount of friction between the user's foot and the insole of the shoe is minimized. The lubricant material could be an inert non-viscous liquid or a lubricant powder, such as powdered PTFE, for example, which can reduce the coefficient of friction significantly below that of the bare thin plastic film 12. The comfort insert 10 minimizes the amount of shear stress applied to the skin of the user's foot as the foot moves in all planes within any loose space 40 available within the shoe 30. As shown in FIG. 5, a portion of the layers of the film material 12 may be substantially parallel t one another. Even though there may be multiple layers of the film material 12 in the body 14 of the comfort insert 10, because the thickness 13 of each layer is so thin, the total thickness of the comfort insert 10 where it is fully compressed is similar to the thickness of an ordinary men's sock and is thus barely noticeable, if at all.

As indicated by the arrow 48, when various layers of the film material 12 slide with respect to one another the film material 12 may roll through the folds and thus move the folds within the body 14. Depending on the amount of resiliency of the thin film material 12, and partly depending upon the thickness 13, the body 14 will have some overall resiliency, tending to oppose compression of the body 14 as indicated by the arrow 50, and thus can provide some cushioning for the user's foot. As illustrated in FIG. 5, surfaces of the thin film material 12 may bulge outward through the mesh of a containment member 18 of netting material, as at 52, enabling the comfort insert 10 to move within the user's shoe and thus adjust its position during use.

The comfort insert 10 as described above ordinarily will remain generally where desired within an enclosed shoe. However, when used in open shoes such as women's dress shoes or sandals, it may be desired to provide some additional security to prevent the comfort insert 10 from moving away from a desired position within or on a person's footwear. For that purpose, an adhesive material compatible with the thin film material 12 may be applied to the comfort insert 10 after it is assembled, as by spraying a small amount of an adhesive or a nonslip material onto an area 54 of the comfort insert 10, shown in FIG. 1D. By placing the comfort insert 10 with the area 54 of adhesive or nonslip material in contact with the insole or exposed upper surface of the shoe or sandal, the comfort insert may be retained in a desired location with respect to the footwear during use.

While assembly of the comfort insert 10 as described above may be accomplished simply, a somewhat different but generally similar comfort insert may be constructed by stacking and enclosing a number of smaller sheets of thin plastic film material 12 having a low coefficient of friction so that they can slide over one another. The multiple sheets of thin plastic film material may be contained between a pair of flat pieces of perforated film material or open mesh netting material 16 interconnected with each other along the peripheries of the material 16. While such a comfort insert as just described can provide the benefits of reducing friction as a result of including multiple layers of thin plastic film material, such construction may provide a lesser amount of cushioning, unless at least some of the smaller sheets of thin plastic film material include folds.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A comfort system to protect a user's foot against friction between a foot and footwear, the comfort system comprising:

footwear; and a comfort insert, comprising:

an inner body component including at least one sheet of folded or crumpled, flexible, thin plastic film material forming a plurality of layers; and a flexible outer containment component encompassing and securely containing the inner body component and thereby limiting an ability of the comfort insert to spread beyond a predetermined size, while permitting the comfort insert to be depressed into a flattened configuration to fit between the user's foot and an interior surface of the footwear, wherein the flexible outer containment component comprises an open mesh netting material with a mesh opening size in the range of 0.20 inch- 0.75 inch, wherein the thin plastic film material has a thickness in the range of 0.0003 inch- 0.003 inch, and wherein the flexible outer containment component encloses the inner body component such that the inner body component remains a loose mass within the flexible outer containment component allowing the plurality of layers to slip and slide along one another's surfaces when the comfort insert is used in the footwear.

2. The comfort system of claim 1, further comprising a low friction fluid located within the containment component.

3. A method of enhancing comfort in footwear, comprising:

placing a comfort insert into footwear in a location configured to be between a user's foot and a surface of the footwear when the footwear is worn by a user, the comfort insert comprising:

a shear-reducing body element including a plurality of layers comprised of a thin plastic film material and a low friction fluid between the plurality of layers, the thin plastic film material folded or crumpled to form the plurality of layers; and a flexible containment element surrounding and enclosing the body element and comprising an open mesh netting material with a mesh opening size in the range of 0.20 inch- 0.75 inch, wherein the mesh openings are large enough to expose portions of the thin plastic film material for user contact and to allow the thin plastic film material to bulge outward through the mesh openings, wherein the flexible containment element encloses the body element such that the shear-reducing body element remains a loose mass within the flexible containment element allowing the plurality of layers to slip and slide along one another's surfaces when the comfort insert is used in the footwear.

4. The comfort system of claim 2, wherein the low friction fluid comprises air or a lubricant.

5. The comfort system of claim 1, wherein the flexible containment element includes an exterior portion including a nonslip outer surface.

6. The comfort system of claim 1, wherein the thin plastic film material has a static coefficient of friction of 0.5 or below.

7. The method of claim 3, wherein the low friction fluid comprises air or a lubricant.

8. The method of claim 3, wherein the thin plastic film material has a thickness in the range of 0.0003 inch –0.003 inch and wherein the mesh opening size is at least 500 times larger than the thickness of the plastic film material.

9. The method of claim 3, wherein the flexible containment element includes an exterior portion including a nonslip outer surface.

10. The method of claim 3, wherein the thin plastic film material has a static coefficient of friction of 0.5 or below.

11. The method of claim 3, further comprising a filament or thread tied around the flexible containment element to maintain the shear-reducing body element within the flexible containment element.

* * * * *